United States Patent [19]

Hester

[11] Patent Number: 4,953,804

[45] Date of Patent: Sep. 4, 1990

[54] ACTIVE LAG ANGLE DEVICE

[75] Inventor: Troy L. Hester, Huntsville, Ala.

[73] Assignee: The United States of America as represented by the Secretary of the Army, Washington, D.C.

[21] Appl. No.: 502,968

[22] Filed: Apr. 2, 1990

[51] Int. Cl.[5] ..... B65H 54/02; B65H 54/28; B65H 57/28

[52] U.S. Cl. ..... 242/47; 242/157.1; 242/158 R

[58] Field of Search ..... 242/47, 158 R, 158.2, 242/25 R, 157.1

[56] References Cited

U.S. PATENT DOCUMENTS

| | | | |
|---|---|---|---|
| 3,031,153 | 4/1962 | Attwood et al. | 242/158 R |
| 3,039,707 | 6/1962 | Beck et al. | 242/158.2 X |
| 3,544,035 | 12/1970 | Woolever | 242/158 R |
| 3,833,184 | 9/1974 | Hara et al. | 242/158 R |
| 4,022,391 | 5/1977 | Stein et al. | 242/158 R X |
| 4,232,838 | 11/1980 | Bravin | 242/158 R |
| 4,373,686 | 2/1983 | Milli | 242/158.2 |
| 4,428,540 | 1/1984 | Calcagno et al. | 242/158 R X |
| 4,535,955 | 8/1985 | Custer | 242/158 R |
| 4,655,410 | 4/1987 | Ruffin et al. | 242/158 R |
| 4,838,500 | 6/1989 | Graham | 242/158 R |

*Primary Examiner*—Stanley N. Gilreath

*Attorney, Agent, or Firm*—Freddie M. Bush; James T. Deaton

[57] ABSTRACT

An active lag angle device in which a structure is provided for mounting an optical fiber to be wound on a bobbin and providing a structure whereby the optical fiber is dispensed along a substantially straight line reference relatively to a reference structure to provide a structure that lends itself to application of adhesive to the fiber just prior to winding on a bobbin.

3 Claims, 1 Drawing Sheet

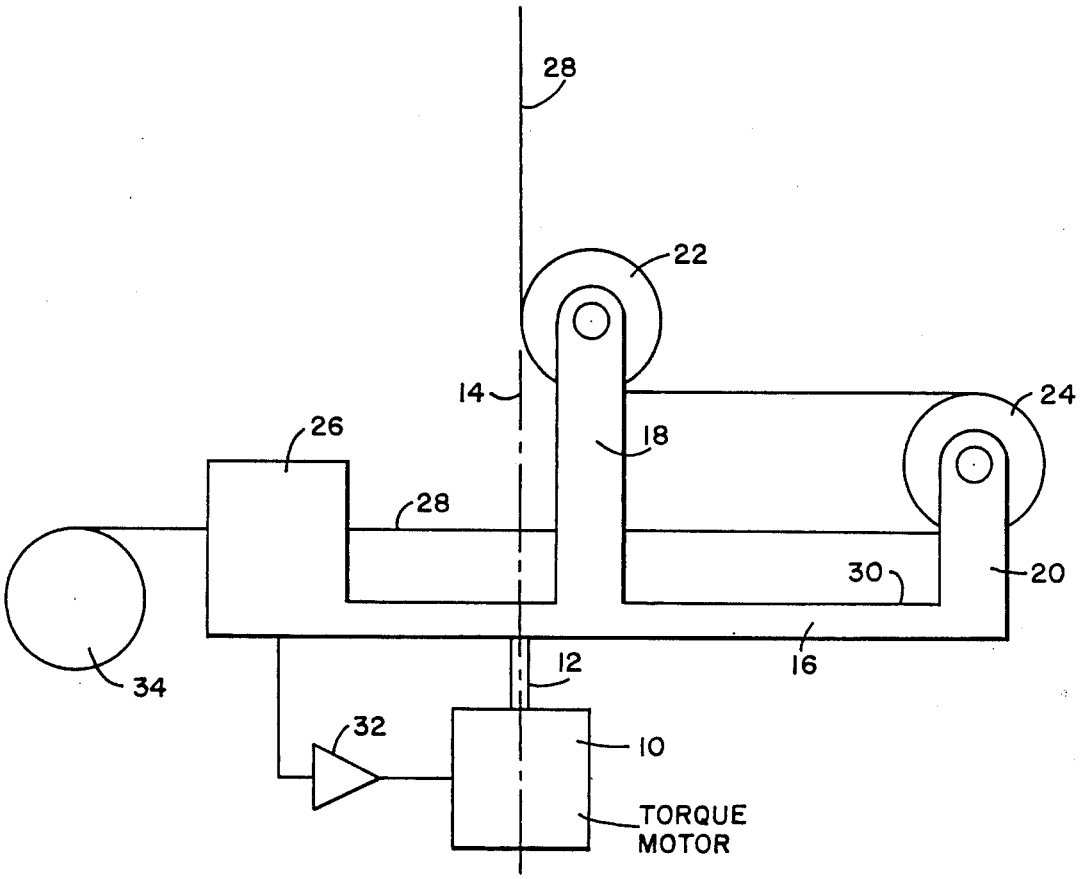
28
22
14
24
26
18
28
30
20
34
12
16
32
10
TORQUE
MOTOR

ACTIVE LAG ANGLE DEVICE

The invention described herein may be manufactured, used, and licensed by or for the Government for governmental purposes without the payment to me of any royalities thereon.

BACKGROUND OF THE INVENTION

A basic problem in winding an optical fiber on a bobbin exist when the fiber must have adhesive applied thereto and in order to accomplish this the fiber needs to be held in a substantially constant position relative to a reference surface. When a bobbin has to be precision-wound with an optical fiber of hundreds of feet, in order to have the fiber dispense properly, the fiber has an adhesive placed thereon as it is being wound to better hold the fiber in place until it is desired to dispense the optical fiber from its bobbin.

Therefore, it is an object of this invention to provide an active lag angle device that allows an optical fiber to be held in a substantially constant position relative to a reference surface in the presence of a lead or lag angle while the optical fiber is being precision-wound on a bobbin.

Another object of this invention is to provide a device which enables an optical fiber to have a substantially constant position relative to its support in order to allow position-sensitive apparatus such as adhesive application systems to be mounted to the reference surface and contact the optical fiber for adhesive application.

Still another object of this invention is to provide a device that enables the fiber segment that is held in the substantially constant position relative to a reference surface to experience no further contact until it is wound on a bobbin.

Other objects and advantages of this invention will be obvious to those skilled in this art.

SUMMARY OF THE INVENTION

An active lag angular device is provided in which an electric torque motor is mounted and has a rotary shaft that is connected to a reference surface structure for rotating the reference surface structure about an axis of rotation that coincides with the axis of the rotor of the motor. The reference surface structure has pulleys mounted thereon so that an optical fiber can approach the active lag angle device at a guide pulley along an axis that coincides with the axis of the rotator shaft of the motor and be turned by the pulleys and directed along a substantially constant position relative to the reference surface structure. The reference surface structure has a conventional position sensor that senses the position of the optical fiber relative to the reference structure to maintain the optical fiber in a substantially constant position relative to reference surface by the optical sensor producing signals that are amplified and used to control the electric torque motor to maintain the optical fiber in the substantially constant position relative to the reference surface structure.

DESCRIPTION OF THE DRAWING

The single FIGURE of the drawing is a schematic side view of an active lag angle device in accordance with this invention.

DESCRIPTION OF THE PREFERRED EMBODIMENT

Referring now to the drawing, the active lag angle device includes a torque motor 10 that is fixedly mounted and has a rotary shaft 12 that is a part of the rotor of torque motor 10. Rotary shaft 12 is designed for turning about center line axis 14. Shaft 12 is integrally secured to reference surface structure 16 in a conventional manner and reference surface structure 16 has integral supports 18 and 20 projecting there from for mounting guide pulley 22 by support 18 and outrigger pulley 24 by support 20. Reference surface structure 16 also has a position sensor 26 mounted at one end. An optical fiber 28 is mounted to approach and contact pulley 22 so that optical fiber 28 approaches pulley 22 along axis 14. Pulley 22 is used to turn optical fiber 28 90° which is then wrapped around pulley 24 for turning fiber 28 180° to present optical fiber 28 above upper surface 30 of reference surface structure 16. It is desired to maintain a substantially constant position of fiber 28 above surface 30 and substantially along a straight line of surface 30. This is desired in order to have other means mounted on surface 30 for applying adhesive to optical fiber 28. To maintain optical fiber 28 in the substantially constant position above surface 30 and centered, position sensor 26 detects the position of optical fiber 28 relative to a centered line reference on surface 30. Deviations from the center line reference by optical fiber 28 are detected by detectors of position sensor 26 and produce output signals to amplifier 32 which drives torque motor 10. Torque motor 10 then causes shaft 12 to rotate and maintain optical fiber 28 in a centered position relative to the desired center line reference of surface 30. Rotation of shaft 12 must be aligned with the approaching optical fiber in order to prevent any adverse effect of the turning on optical fiber 28. After optical fiber 28 passes position sensor 26, the end of the optical fiber is then ready for winding on a mandrel 34 as illustrated. Position sensor 26 is a conventional analog type sensor that can be purchased as an EG & G Model YAG444-4 from EG and G Photon Devices 35 Congress Street; Salem, Mass. 01970.

In operation, fiber 28 approaches guide pulley 22 as illustrated and is turned 90° and then wound 180° about pulley 24 to position optical fiber 28 in a suspended position between outrigger pulley 24 and bobbin 34 for winding optical fiber 28 as it passes along the center line of surface 30 and over the sensors of position sensor 26. Position sensor 26 has sensors that sense outputs of an error signal proportional to the distance of optical fiber 28 from the center line of reference surface 30. This error signal produced by the detectors of position sensor 26 is amplified by amplifier 30 and used to drive torque motor 10. The motion of torque motor 10 through shaft 12 drives reference surface structure 16 and the pulleys mounted thereon such that fiber 28 is driven back to the center line position of surface 30 to maintain optical fiber 28 in a substantially constant position relative to the center line of surface 30.

I claim:

1. An active lag angle device for an optical fiber being wound on a bobbin comprising a torque motor with a housing thereof adapted to be fixedly mounted, said torque motor having a rotary output shaft projecting therefrom, a reference surface structure secured to said shaft and being integral therewith, said reference surface structure having an outrigger pulley mounted at one end thereof, a guide pulley mounted on said reference surface structure at an intermediate section thereof with the circumferential surface of the guide pulley being tangent to a center line axis of the rotary output shaft, and the opposite end of said reference surface structure from said outrigger pulley having a position sensor mounted thereat, said position sensor sensing deviations of an optical fiber when the optical fiber is positioned along said axis to said guide pulley is turned 90° by said pulley to said outrigger pulley which turns the optical fiber 180° to position the optical fiber above a predetermined reference line on said reference surface structure and producing output signals for controlling the torque motor to maintain the optical fiber relative to said reference line.

2. An active lag angle device as set forth in claim 1, wherein the output signals of said position sensor are fed to an amplifier which utilizes the signals to control said torque motor.

3. An active lag angle device as set forth in claim 2, wherein said optical fiber is directly wound on a bobbin after passing said position sensor.

* * * * *